US006617915B2

(12) United States Patent
Rajan

(10) Patent No.: US 6,617,915 B2
(45) Date of Patent: Sep. 9, 2003

(54) LOW POWER WIDE SWING CURRENT MIRROR

(75) Inventor: Reghu Rajan, San Diego, CA (US)

(73) Assignee: Zarlink Semiconductor (U.S.) Inc., San Diego, CA (US)

( * ) Notice: Subject to any disclaimer, the term of this patent is extended or adjusted under 35 U.S.C. 154(b) by 0 days.

(21) Appl. No.: 10/000,767

(22) Filed: Oct. 24, 2001

(65) Prior Publication Data

US 2003/0076158 A1 Apr. 24, 2003

(51) Int. Cl.[7] ..... G05F 1/10; G05F 3/02

(52) U.S. Cl. ..... 327/538; 327/543; 323/315; 330/288

(58) Field of Search ..... 323/312, 315, 323/317; 330/288; 327/538, 543

(56) References Cited

U.S. PATENT DOCUMENTS 4,495,425 A * 1/1985 McKenzie ..... 327/541
4,525,682 A * 6/1985 Lai et al. ..... 330/288
4,937,515 A * 6/1990 Yoshino ..... 323/315
5,083,079 A * 1/1992 Plants ..... 323/313
5,099,205 A * 3/1992 Lewyn ..... 330/288
5,680,038 A 10/1997 Fiedler ..... 323/315
5,696,440 A * 12/1997 Harada ..... 323/315
5,801,523 A * 9/1998 Bynum ..... 323/315
5,966,005 A 10/1999 Fujimori ..... 323/315
6,249,176 B1 6/2001 Pease ..... 327/538

FOREIGN PATENT DOCUMENTS

JP 296411 * 4/1990 ..... 323/315

* cited by examiner

*Primary Examiner*—Tuan T. Lam
(74) *Attorney, Agent, or Firm*—Knobbe Martens Olson & Bear LLP

(57) ABSTRACT

A low power wide swing current mirror circuit wherein the signal current is separated from the bias current, and a bias current sink is connected in parallel with a current mirror so as to shunt the bias current to the circuit common.

15 Claims, 5 Drawing Sheets

LOW POWER WIDE SWING CURRENT MIRROR

BACKGROUND OF THE INVENTION

1. Field of the Invention

The invention relates to analog circuits, and more particularly to low power current mirrors.

2. Description of the Related Art

Current mirrors are important building blocks of any analog design. Some of the desired qualities of a current mirror include accuracy in mirroring the current from input to output, which can require a high level of transistor matching, a high output impedance to reduce mirroring errors at varying output voltage levels, and high bandwidth, especially when the current mirror is in the signal path. Other desirable attributes of a current mirror may include low voltage operation, low power consumption, and low operating head room for input and output terminals, which is the lowest voltage to be maintained at the input and output of the mirror for proper functioning.

Unfortunately, the majority of current mirrors cannot be designed to achieve all of the above listed qualities and are typically designed specifically for their application environment. Maximizing a single quality will most likely result in the compromise of another.

A basic current mirror is formed by two MOS transistors. The first transistor is coupled as a diode-connected device and generates a bias voltage in response to an input current. The second transistor receives the bias voltage at a gate terminal and generates an output current at its drain terminal which is proportional to the input current. A common adaptation to the basic current mirror is a cascode current mirror, implementing an additional pair of transistors, one each in series with the transistors of the basic current mirror configuration.

FIGS. 1–3 are schematic illustrations of various current mirrors of the prior art. Basic current mirror structure is illustrated in FIG. 1. A conventional current mirror 100 is consists of a current source biasing circuit formed from a diode-connected transistor 102 and an output current source formed with a single output transistor M2 104. In FIG. 1, transistor 102 receives an input current $I_{in}$ and generates a bias voltage in response which is received by the transistor M2 104 at its gate terminal. Transistor M2 104 generates an output current $I_{out}$ at its drain terminal. Although the current mirror 100 of FIG. 1 implements a simple design, there are significant drawbacks. There is very little signal room at the input, which is limited by the matching of the design, and low output impedance. A low output impedance can generate mirroring errors due to changes in drain-to-source voltage drops of the output transistor M2 104. Low output impedance can also account for reduced gains when the mirror is used as an active load. The gain can be enhanced by adding cascode transistors, which reduces the drain modulation of the transistors and boosts the impedance.

An exemplary cascode current mirror 200 of the prior art is illustrated in FIG. 2 where a transistor 152 receives an input current and a transistor 154, having a common gate bias voltage, $V_{bias}$, with transistor 152, generates an output current. Transistors 152 and 154 have been added to boost the impedance of the input and output nodes of the mirror illustrated in FIG. 1. Transistor 202 and transistor 152 are coupled in series, and transistors 154 and 204 are coupled in series. Transistors 202 and 204 have a common gate connection which is coupled to the drain of transistor 152. Transistor 202 generates the bias voltage for transistor 204. With the added stage, the mirror input still requires a gate-to-source transistor voltage drop, and the input signal room is reduced.

The enhanced impedance current mirror of FIG. 2 can be improved at the cost of power with the wide-swing current mirror 300 illustrated in FIG. 3. Instead of applying the input current $I_{in}$ to the drain of transistor 152, it is injected at the drain of transistor 202, and only a bias current $I_{bias}$ 302 is applied to transistor 152.

The wide-swing current mirror 300 has a very high input signal room such that it only requires a drain-to-source voltage drop (usually less than 150 mV) to operate. Transistors 152 and 202 form a closed current-to-voltage amplifier loop such that, at zero input current, only the bias current is mirrored to the output. In operation, injection of current at the input node lowers the gate-to-source voltage of transistor 152, which in turn increases the gated drive of transistor 202. Transistor 202 drains the extra current injected to the input node, which is mirrored to transistor 204. Drawbacks to this design include the need for a bias current to be continuously operating, and the high power consumption due to the high bias current being mirrored to the output in addition to the input current. In addition, for high bandwidth applications the pole of the mirror needs to be carefully placed beyond the signal bandwidth, which requires a sufficient bias current. This increased bias current causes the mirror to consume excessive power, especially at mirroring ratios greater than one.

Analog designs aimed to operate from a voltage source in the range of 1 Volt generally cannot afford to have two gate-to-source transistor voltage drops on one voltage supply to ground path (cascode current mirror). Such voltage drops may not be a problem when the mirror is used simply as a current source, wherein the input head room is one gate-to-source transistor voltage drop and is of low importance. However, if a current signal from a differential pair or an intermediate stage of a circuit is the subject of the current mirror, the input operating voltage, which is typically at least one gate-to-source transistor voltage drop, makes the two gate-to-source transistor voltage drops intolerable for operation.

Many improvements have been made to the basic current mirror, however, many adaptations result in disadvantages such as low output resistance, reduced signal room, and high power consumption. Therefore, a current mirror overcoming such disadvantages is needed in the art.

SUMMARY OF THE INVENTION

A current mirror circuit, comprising a bias current input port, a signal current input port, an output current port, a mirroring circuit receiving said bias current and said signal, and a bias current sink connected to said mirroring circuit so as to shunt said bias current to circuit common. The bias current sink may comprise a transistor receiving a gate bias voltage, the signal current, and be connected in parallel with the mirroring circuit. The mirroring circuit can be a cascode mirroring circuit.

A wide swing current mirror circuit has an input stage and an output stage, wherein a bias current is separated from a signal current at the input stage, and wherein a bias current sink is connected in parallel with at least a portion of the input stage such that the bias current is not mirrored to the output stage. The bias current sink can be a transistor having a gate bias voltage.

A method of reducing power consumption in a current mirror, comprising routing a bias current and a signal current to circuit common via different paths, such that the bias current is not mirrored to an output of the analog current mirror. Routing the bias current to circuit common may include a bias current sink transistor having a gate bias voltage.

A circuit for mirroring an electrical current, comprising a bias current input terminal, a signal current input terminal, and five transistors. The first transistor has a biased gate terminal and a drain terminal which receives the bias current, and the second transistor has a gate terminal connected to the gate terminal of said first transistor. The third transistor has a drain terminal connected to the source terminal of the first transistor, a gate terminal connected to the drain terminal of the first transistor, and a source terminal connected to ground. The fourth transistor has a drain terminal connected to the source terminal of the second transistor, a gate terminal connected to the gate terminal of the third transistor, and a source terminal connected to ground. The fifth transistor has a drain terminal connected to the drain terminal of the third transistor, a source terminal connected to the source terminal of the third transistor, and a gate terminal receiving a bias voltage input. The drain terminal of the third transistor and the drain terminal of the fifth transistor receive the signal current.

A current mirror circuit, comprising a transistor pair forming a current mirror and configured to receive a bias current and an input current, and means for sinking the bias current to circuit common around the transistor pair. The means for sinking the bias current can comprises a transistor having a gate bias voltage and receiving the input current, and connected in parallel with the current mirror.

A current mirror circuit comprising a first mirrored input transistor, a first mirroring output transistor, and a bias current sink transistor connected in parallel with the first mirrored input transistor. The current mirror circuit may further comprise a second mirrored input transistor in series with the first mirrored input transistor, and a second mirroring output transistor connected in series with the first mirroring output transistor.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 4:
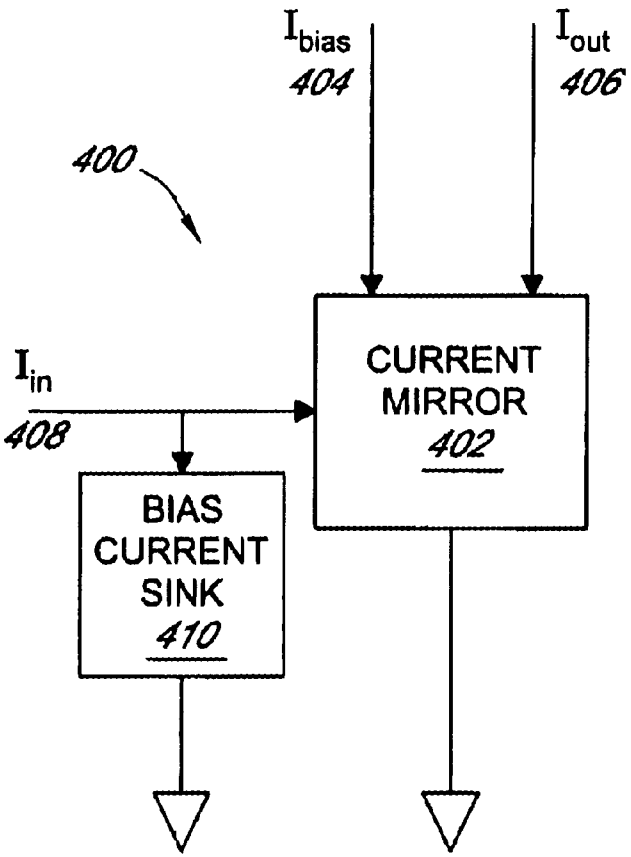
FIG. 4 is a block diagram of a current mirror circuit of the present invention.

FIG. 4 is a block diagram illustrating one embodiment of a low power current mirror circuit 400 of the present invention. The circuit 400 comprises a current mirror 402 which receives a bias current 404 and produces an output current 406. The input section of the circuit 400 comprises an input current 408 which is injected into a bias current sink 410 and the current mirror 402 in parallel. Including the bias current sink 410 provides for conservation of significant power. By sinking the bias current, it is not mirrored to the output of the mirror, thereby reducing power consumption of the circuit at any input current.

Figure 5:
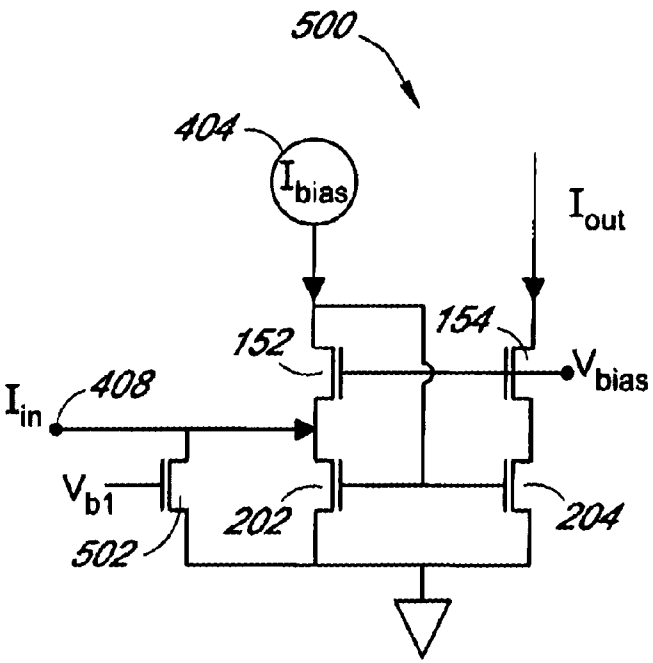
FIG. 5 is a schematic illustration of one embodiment of the current mirror of the present invention.

FIG. 5 is a schematic illustration of one embodiment of an implementation of the current mirror circuit 400 of FIG. 4. The current mirror circuit 500 of FIG. 5 includes the wide-swing current mirror 300 of FIG. 3 along with an additional transistor 502 implemented as the bias current sink 410 of FIG. 4. The drain of transistor 502 is coupled to the drain of transistor 202, and the source of transistor 502 is coupled to the source of transistor 202. Transistor 502 receives a bias voltage input $V_{b1}$ at it's gate at a level selected to sink the bias current to circuit common. The input current $I_{in}$ is now injected at the common drain terminal of transistors 502 and 202, such that when the input current $I_{in}$ is at a negligible level, transistor 202 is turned off and the output current is therefore negligible. More specifically, transistor 202 is spared from sinking $I_{bias}$ which saves a multiplied $I_{bias}$ current from being mirrored to the output, and therefore saving considerable power.

The method of dividing bias currents and signal currents can also be applied to circuits other than current mirrors, such as amplifier circuits. By dividing the signal current and the bias current before mirroring or amplification to an output stage, power is conserved along with transistor area, and parasitic parameters can be reduced.

Figure 6:
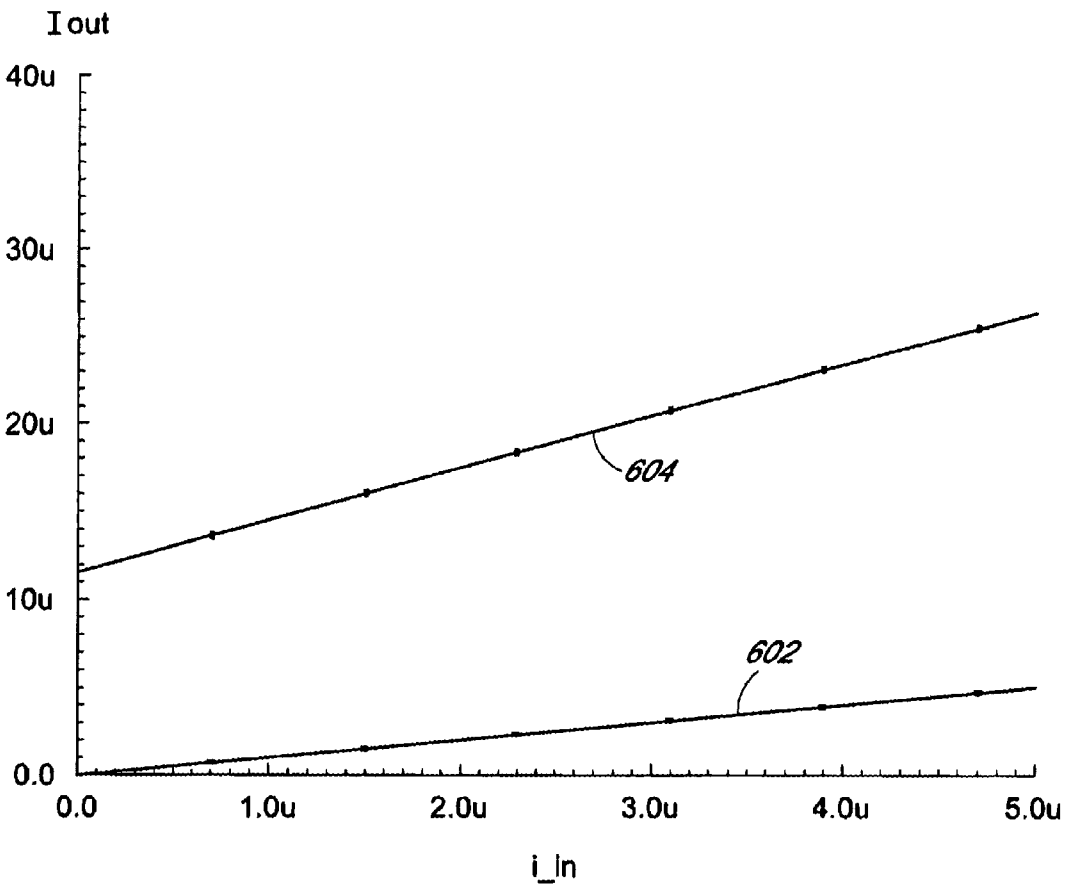
FIG. 6 is a graphical illustration of the output current and input current for a simulation of the prior art current mirror of FIG. 3.
Figure 7:
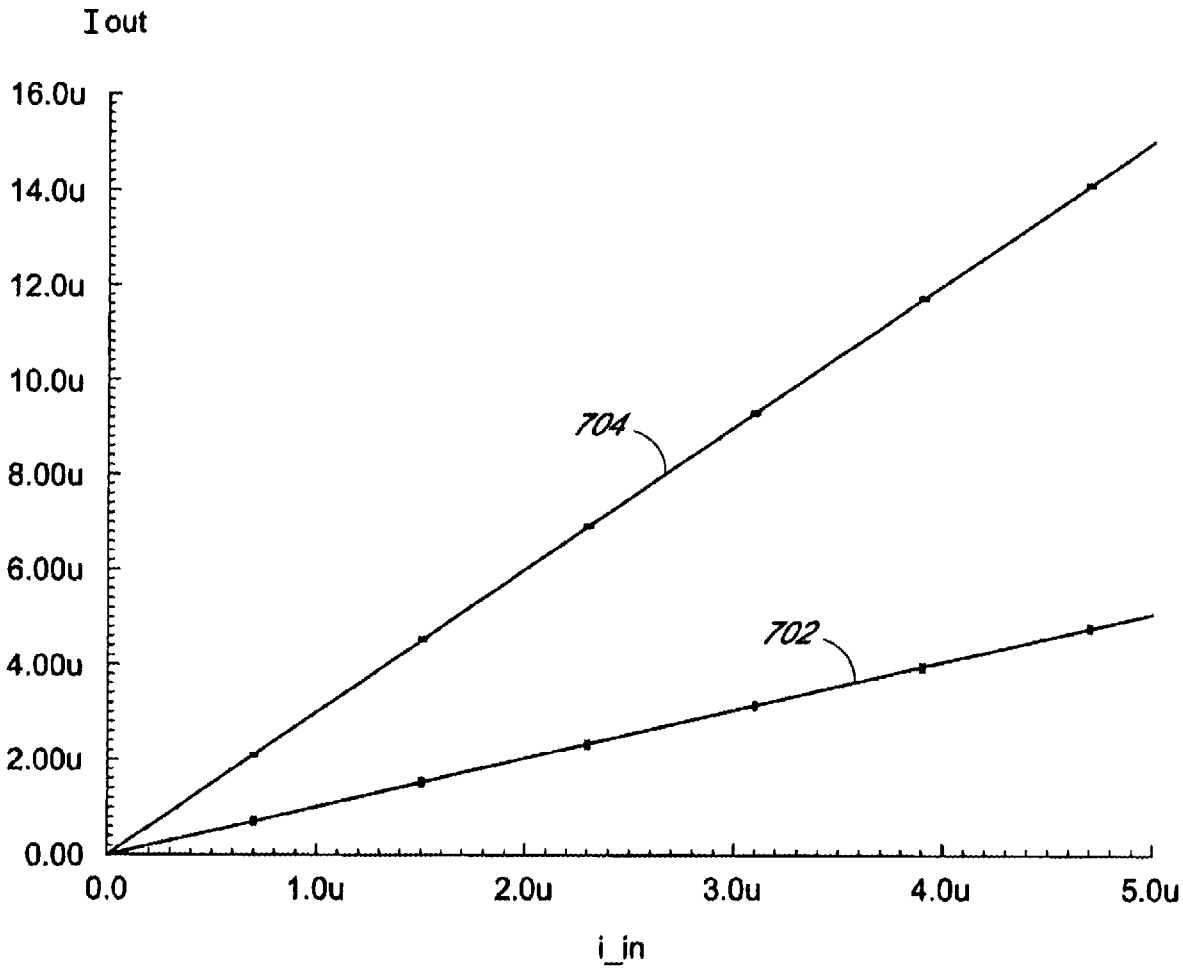
FIG. 7 is a graphical illustration of the output current and input current for a simulation of the current mirror circuit of FIG. 5.

FIGS. 6 and 7 illustrate the reduction in power consumption of the current mirror circuit 500 as compared to the prior art. The graph of FIG. 6 illustrates an input current trace 602 and an output current trace 604 of a computer simulation of the conventional current mirror illustrated in FIG. 3 at a 3×mirroring ratio. As can be seen, at a zero input current 602 level, the output current 604 is at an offset level of 11.55 $\mu$A. By adding the bias current sink transistor 502 to the simulation circuit, the graph of FIG. 7 is obtained having an input current trace 702 and an output current trace 704. The graphical illustration of FIG. 7 shows an output current 704 offset of nearly zero amps (96.3 nA), a great improvement over the 11.55 $\mu$A produced with the prior art current mirror.

Figure 3:
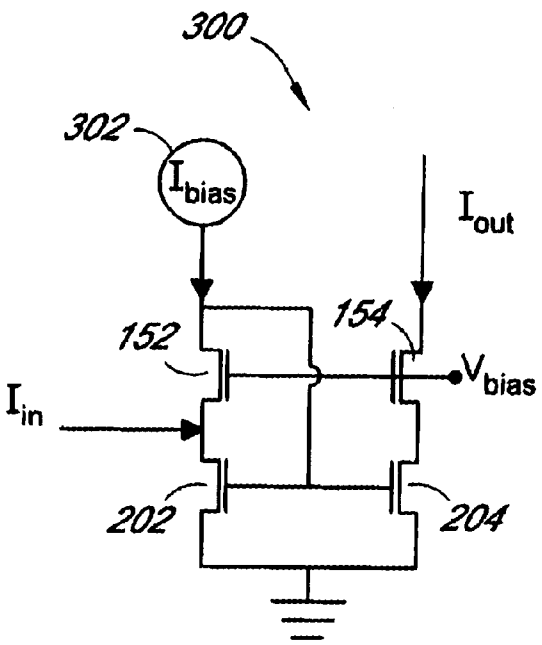
FIG. 3 (PRIOR ART)
FIG. 3 is a schematic illustration of a wide-swing current mirror of the prior art.
Figure 2:
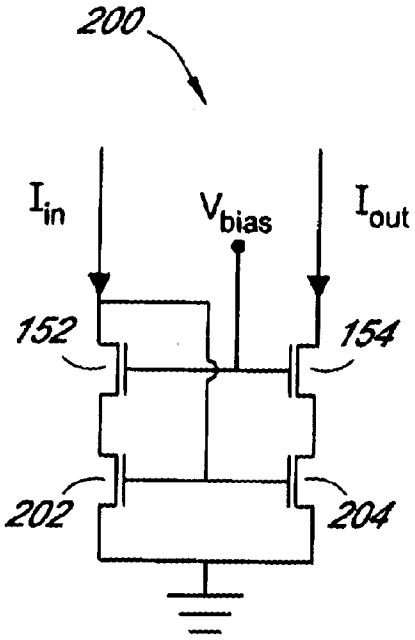
FIG. 2 (PRIOR ART)
FIG. 2 is a schematic illustration of a cascode current mirror of the prior art.
Figure 1:
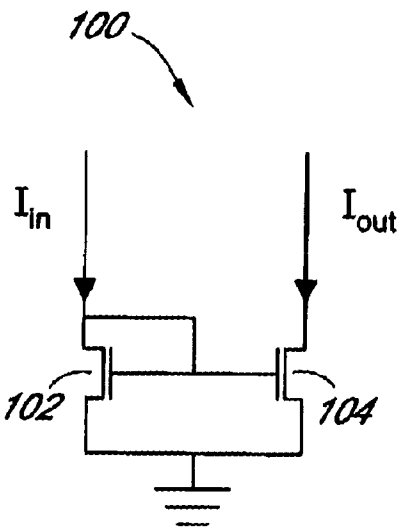
FIG. 1 (PRIOR ART)
FIG. 1 is a schematic illustration of a basic current mirror of the prior art.
Figure 8:
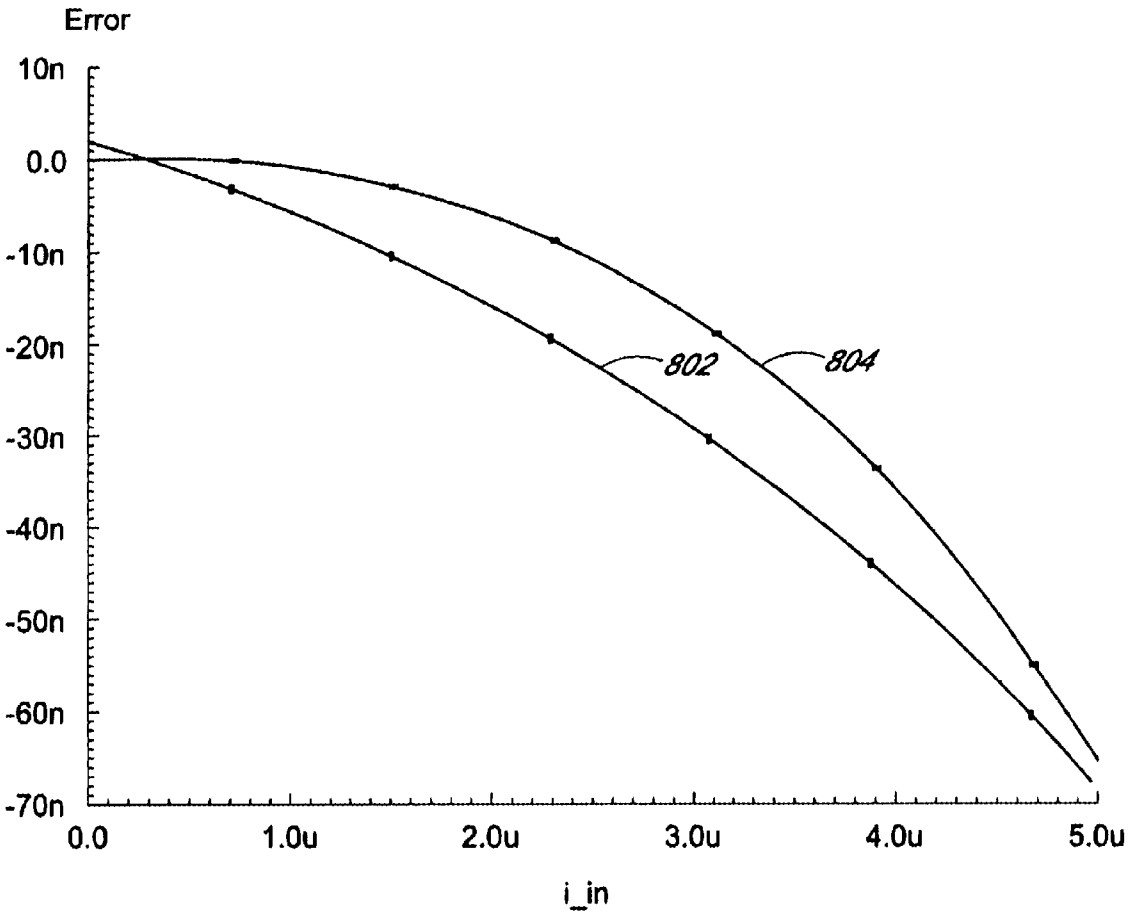
FIG. 8 is a graphical illustration of linearity error as a function of input current for a simulation of the prior art current mirror of FIG. 3 and the current mirror circuit of FIG. 5.

FIG. 8 is a graphical illustration of linearity error as a function of input current for a simulation of the prior art current mirror of FIG. 3 and the current mirror circuit of FIG. 5. A trace 802 illustrates a linearity curve for a wide swing current mirror without a current bias sink, and a trace 804 illustrates a linearity curve for a low power, wide swing current mirror of the present invention. As shown, the low power current mirror has a marginally improved linearity over the wide swing current mirror of the prior art.

The design methodology for the current mirror 500 typically flows from the input and output current specifications for the application. These specifications typically set the geometry ratio for transistors 202 and 204. For a given transistor area, the lowest inversion coefficient can be calculated to meet the transistor matching requirement of the specifications of the application. This calculation sets the lowest drain-to-source voltage $V_{DS}$ so as to maximize the signal swing, which completes the full geometry of transistors 202 and 204. The bias current $I_{bias}$, and hence the geometry of transistor 152, is based on the bandwidth of the application. The pole of the mirror 500 is dominated by the combined gate capacitance of transistors 202 and 204. The lowest power consumption for the mirror is achieved by a minimum $I_{bias}$ so as to push the pole of the mirror out of system bandwidth. Finally, transistor 502 is advantageously designed and biased to sink $I_{bias}$ and maintain an equal or lesser $V_{DSAT}$ than that of transistor 152.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A current mirror circuit, comprising:

a bias current input port;

a signal current input port;

an output current port;

a mirroring circuit, receiving said bias current and said signal, wherein said bias current biases at least one mirrored transistor in said mirroring circuit; and a bias current sink, connected to said mirroring circuit so as to shunt at least some of said bias current to circuit common such that essentially no bias current is mirrored to said output current port.

2. The current mirror circuit of claim 1, wherein said bias current sink comprises a transistor receiving a gate bias voltage, said signal current, and connected in parallel with said mirroring circuit.

3. The current mirror circuit of claim 1, wherein said mirroring circuit is a cascode mirroring circuit.

4. A wide swing current mirror circuit, having an input stage and an output stage, wherein a bias current that biases at least one transistor in said input stage is separated from a signal current at said input stage, and wherein a bias current sink is connected in parallel with at least a portion of said input stage, such that essentially no bias current is mirrored to said output stage.

5. The wide swing current mirror circuit of claim 4, wherein said bias current sink is a transistor having a gate bias voltage.

6. A method of reducing power consumption in a current mirror, comprising combining both a bias current and a signal current in a mirroring circuit, and routing said bias current and said signal current to circuit common via different paths, such that essentially no bias current is mirrored to an output of said current mirror.

7. The method of claim 6, wherein said routing said bias current to circuit common includes a bias current sink transistor having a gate bias voltage.

8. A circuit for mirroring an electrical current, comprising:

a bias current input terminal;

a signal current input terminal;

a first transistor having a biased gate terminal, a drain terminal, and a source terminal, wherein said drain terminal receives said bias current;

a second transistor having a gate terminal connected to said gate terminal of said first transistor, a drain terminal, and a source terminal;

a third transistor, having a gate terminal, a drain terminal, and a source terminal, wherein said drain terminal is connected to said source terminal of said first transistor, said gate terminal is connected to said drain terminal of said first transistor, and said source terminal is connected to ground;

a fourth transistor, having a drain terminal connected to said source terminal of said second transistor, a gate terminal connected to said gate terminal of said third transistor, and a source terminal connected to ground; and a fifth transistor, having a drain terminal connected to said drain terminal of said third transistor, a source terminal connected to said source terminal of said third transistor, and a gate terminal receiving a bias voltage input, wherein said drain terminal of said third transistor and said drain terminal of said fifth transistor receive said signal current.

9. A current mirror circuit, comprising:

a transistor pair forming a current mirror and configured to receive a bias current and an input current, wherein said bias current biases at least one transistor in said current mirror; and means for sinking at least some of said bias current to circuit common around said transistor pair.

10. The current mirror circuit of claim 9, wherein said means for sinking said bias current comprises a transistor, having a gate bias voltage and receiving said input current, connected in parallel with said current mirror.

11. A current mirror circuit comprising:

a first mirrored input transistor receiving both a signal current and a bias current;

a first mirroring output transistor; and a bias current sink transistor connected in parallel with said first mirrored input transistor so as to shunt at least a portion of said bias current from said first mirrored input transistor.

12. The current mirror circuit of claim 11, further comprising a second mirrored input transistor in series with said first mirrored input transistor, and a second mirroring output transistor connected in series with said first mirroring output transistor.

13. A current mirror circuit, comprising:

a bias current input port;

a signal current input port;

an output current port;

at least one mirrored transistor, receiving said bias current and said signal current; and a bias current sink, connected to said signal current input port and said mirroring circuit such that essentially no bias current is mirrored to said output current port.

14. The current mirror circuit of claim 13, wherein said bias current sink comprises a transistor connected in parallel with at least a portion of said at least one mirrored transistor.

15. The current mirror circuit of claim 13, wherein said at least one mirrored transistor is part of a cascode mirroring circuit.

* * * * *